US010632337B2

(12) United States Patent
White

(10) Patent No.: US 10,632,337 B2
(45) Date of Patent: Apr. 28, 2020

(54) PERFORMANCE TRAINING GARMENT

(71) Applicant: Benjamin L White, Rahway, NJ (US)

(72) Inventor: Benjamin L White, Rahway, NJ (US)

( * ) Notice: Subject to any disclaimer, the term of this patent is extended or adjusted under 35 U.S.C. 154(b) by 172 days.

(21) Appl. No.: 15/730,987

(22) Filed: Oct. 12, 2017

(65) Prior Publication Data

US 2019/0111307 A1 Apr. 18, 2019

Related U.S. Application Data

(60) Provisional application No. 62/451,553, filed on Jan. 27, 2017.

(51) Int. Cl.

| | |
|---|---|
| ***A63B 21/00*** | (2006.01) |
| ***A41D 1/08*** | (2018.01) |
| ***A63B 21/008*** | (2006.01) |
| ***A41D 1/00*** | (2018.01) |
| ***A63B 24/00*** | (2006.01) |
| ***D04B 1/16*** | (2006.01) |

(Continued)

(52) U.S. Cl.

CPC ..... *A63B 21/4025* (2015.10); *A41B 1/08* (2013.01); *A41D 1/002* (2013.01); *A41D 1/08* (2013.01); *A63B 21/0085* (2013.01); *A63B 21/4007* (2015.10); *A63B 21/4011* (2015.10); *A63B 21/4017* (2015.10); *A63B 21/4043* (2015.10); *A63B 24/0087* (2013.01); *D04B 1/16* (2013.01); *D04B 1/24* (2013.01); *A41D 2300/20* (2013.01); *A41D 2500/10* (2013.01); *A41D 2600/10* (2013.01); *A63B 2209/00* (2013.01); *A63B 2225/50* (2013.01); *D10B 2201/02* (2013.01); *D10B 2331/04* (2013.01); *D10B 2331/10* (2013.01); *D10B 2501/04* (2013.01); *D10B 2501/06* (2013.01)

(58) Field of Classification Search

CPC . A41B 1/08; A41D 1/002; A41D 1/08; A41D 2300/20; A41D 2500/10; A41D 2600/10; A63B 21/0085; A63B 21/4007; A63B 21/4011; A63B 21/4017; A63B 21/4025; A63B 21/4043; A63B 24/0087; A63B 2209/00; A63B 2225/50; D04B 1/16; D04B 1/24; D10B 2201/02; D10B 2331/04; D10B 2331/10; D10B 2501/04; D10B 2501/06

See application file for complete search history.

(56) References Cited

U.S. PATENT DOCUMENTS

| | | | |
|---|---|---|---|
| 5,943,700 | A | 8/1999 | Hammer |
| 8,312,566 | B2 | 11/2012 | Weir |

(Continued)

*Primary Examiner* — Megan Anderson

(57) ABSTRACT

Present invention discloses a performance training garment, particularly a whole-body performance training garment which in a single garment covers, essentially, the wearer's major portions such as torso, arms and legs. The garment body is incorporated with a series of inflatable bladders to provide external resistance to the wearers muscles. The body of the garment also includes a network of supply lines that is responsible for supplying an air inflation medium to the bladders. The inflation and deflation is controlled by a control device that has wearer operated interface. The performance training garment as disclosed herein provides the effect of exercising in a high-G environment by furnishing external resistance against which the wearer's muscles contracts.

19 Claims, 13 Drawing Sheets

(51) Int. Cl.
*D04B 1/24* (2006.01)
*A41B 1/08* (2006.01)

(56) References Cited

U.S. PATENT DOCUMENTS

| | | | | |
|---|---|---|---|---|
| 8,443,465 | B2 | 5/2013 | Stewart | |
| 9,168,413 | B2 | 10/2015 | Petrakis | |
| 9,867,404 | B1 * | 1/2018 | Holtzman | A41D 1/084 |
| 10,271,591 | B2 * | 4/2019 | Bangera | A41D 13/018 |
| 2003/0092544 | A1 | 5/2003 | Reed | |
| 2017/0295860 | A1 * | 10/2017 | Hall | A41D 13/002 |
| 2018/0184735 | A1 * | 7/2018 | Longinotti-Buitoni | A61B 5/6831 |

* cited by examiner

PERFORMANCE TRAINING GARMENT

CROSS REFERENCE TO RELATED APPLICATION

This application claims benefit of U.S. Provisional Application No. 62/451,553 filed on 27 Jan. 2017 which is hereby incorporated by reference.

TECHNICAL FIELD OF INVENTION

Generally, the present disclosure relates to equipment for resistance exercise training. More particularly, the present disclosure relates to a performance framing garment.

BACKGROUND OF THE INVENTION

Resistance training is one of the oldest forms of physical training known to humankind. Egyptian tombs show pictures of exercise equipment made with sandbags and diagrams of swinging and throwing exercises. Aristotle and Plato both spoke of the virtues of physical development. It is also known that ancient European tribes used primitive resistance training equipment.

The first dumbbells were created in the 18th century by placing a rod between two church bells from which the clappers had been removed. Because the bells were silent, they were called "dumbbells," Indian clubs and kettlebells became popular in the 19th century. Over the decades, weight-training equipment continued to evolve until the invention of plate-loaded barbells in the early 20th century. In spite of its long history, users of resistance training equipment tended to be athletes like professional strongmen, who performed feats of strength at exhibitions and contests. Even after the invention of plate-loaded barbells, interest in resistance training tended to be limited to strength athletes, such as power lifters and bodybuilders. Athletic coaches tended to look askance at resistance training as a serious training methodology, fearing that developing muscular strength could actually hamper athletic performance.

Although the professional sports world remained suspicious of resistance training, its popularity spread among the population with the result that resistance trailing equipment was widely available in gyms and health clubs patronized by ordinary citizens. Additionally, resistance training equipment could be easily purchased in sporting goods stores. The widespread popularity of resistance training has caused the professional sports world to re-evaluate it as a training methodology, such that, now, most athletes have a resistance component as part of their training, even athletes such as gymnasts and swimmers.

However, very little has been done to widen the scope of improvement in resistance training. Prior arts, specifically apparels, generally are more dependent on placebo effect, providing minor to moderate benefits to the wearer. There lies no training or exercise apparel that induces the notion of 'stress' (otherwise, 'weight of Gravity') on the wearer. In other words, prior arts doesn't implement a fully functional fitness trainer that exercises or trains the body using its natural movement, e.g. walking, running, sitting, everyday body movements, as well athletics natural motion movements. None of the apparatus uses the fundamental movements of the body that is put to do the ordinary cores, into a resistance workout that strengthens the body and is facilitated through apparel. Resistance exercise requires more effort, thereby inducing more energy into the workout which ultimately increases the cardiovascular, respiratory and burns calorie.

In addition to the practice of lifting heavy weights, resistance training also involves the practice of deliberately making movement more difficult and challenging by performing movement exercise under various loads. Additionally, weighted garments, such as vests, enjoy a degree of popularity. Such garments typically include a number of pockets or pouches in which weights may be placed to add resistance in controlled increments. Additionally, systems of wearable mechanical actuators have been used to provide resistance to movement of a wearer. A processor determines an amount of resistance to apply using each of the actuators based on a vertical direction and sends instructions to the actuators. The instructions then cause the actuators to apply resistance to the wearer in a desired amount. Howbeit the process is cumbersome or are proved to be less versatile then that of air induced gravity resistance system.

Taking into account the pros of resistance training and the cons that the prior arts apparel have, there is a standing need for a training tool that provides for a whole body training garment which is embedded with features that supports external resistance to the wearer muscles and that can be controlled or operated by the wearer.

SUMMARY OF THE INVENTION

Present invention discloses a performance training garment, particularly a whole-body performance training garment which in a single garment covers, essentially, the wearer's major portions such as torso, arms and legs. The garment body is incorporated with a series of inflatable bladders to provide external resistance to the wearer's muscles. The body of garment also includes a network of simply lines which is responsible for supplying an air medium to the inflatable bladders (hereinafter, "bladders"). The network of supply lines further comprises a plurality of vales for regulating flow of the air in and out of the bladders.

The inflation and deflation is controlled by a control device that has wearer operated interface. The performance training garment as disclosed herein provides the effect of exercising in a high Gravity (otherwise hereinafter called as "G") environment by furnishing external resistance against which the wearer's muscles contracts. It's more like doing a fully functional workout white one is engaged in ordinary household chores or doing any natural bodily movements. For example, while mowing lawn, one can experience air pressure weight or gravity pressure resisting against the body that consequently demands more energy in mowing, thus, the inducement of more energy increases the muscular activity of the body. This garment is designed to worn on upper body, lower body or on the entire body. The garment is basically a tool to be utilized for full functional performance training. During use, the wearer may inflate, at least partially, any of all of the bladders in order to simulate the effect of resistance training on the muscles and skeletal system of the wearer. The bladders are disposed at positions only on the extremities to order to fully stress and develop the peripheral musculature. Performing physical training with some or all of the bladders inflated to one degree or another has the effect of making the training movements more difficult requiring greater muscle exertion on the part of the wearer, thus simulating an increased gravitational load would be experienced if the wearer is training in a multiple-G environment. Fabricated from an inflatable fabric, the bladders may be placed within sleeves fabricated from carbon-fiber fabric that direct pressure toward the muscles of the wearer's extremities to increase the load tolerated during exercise. In addition to increasing the gravitational load on the extremities, the full functional training enabled by the functional training garment allows the wearer to subject his/her peripheral muscles to greatly increased pressure and impact levels, stressing the wearer's muscles to novel ways not previously possible with conventional resistance training equipment.

It is therefore an objective of the present invention to increase G's (Gravity load, pressure, impact) on the body extremities during the course of natural body moments, thereby strengthens the cardiovascular or respiratory system providing an improved heart function and efficiency, increased calorie burn, fat metabolism, proprioception, balance control and joint and muscle coordination, diminishing reaction time.

It is another objective of the present invention is to provide a full functional exercise and performance training device in form of a wearable garment that can simulate foe effect of high G-resistance on the wearer's muscular and skeletal system by increasing and decreasing the contraction, i.e. Gravitational toads upon the body through the inflatable bladders during the course of training.

How the foregoing objectives are achieved will be clear from the following description. In this context, it is clarified that the description provided is non-limiting and is only by way of explanation.

BRIEF DESCRIPTION OF THE ACCOMPANYING DRAWINGS

The nature and scope of the present invention will be better understood from the accompanying drawings, which are by way of illustration of a preferred embodiment and not by way of any sort of limitation. In the accompanying drawings.

Figure 1:
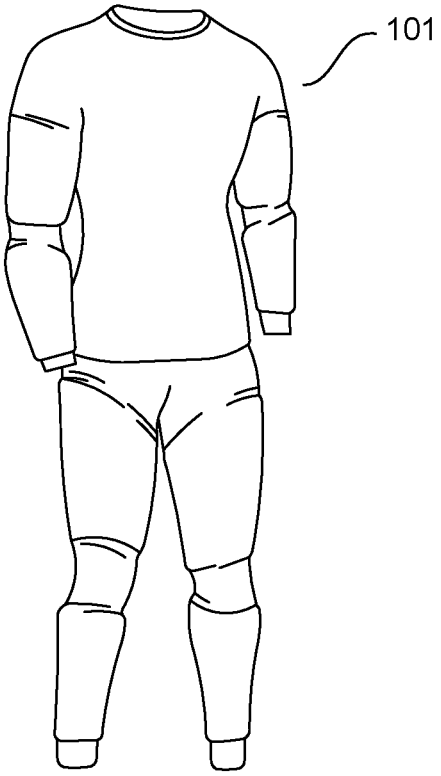
FIG. 1 represents the perspective view of the performance training garment that includes inflatable bladders that is embedded between the layers of garment fabric.
Figure 2:
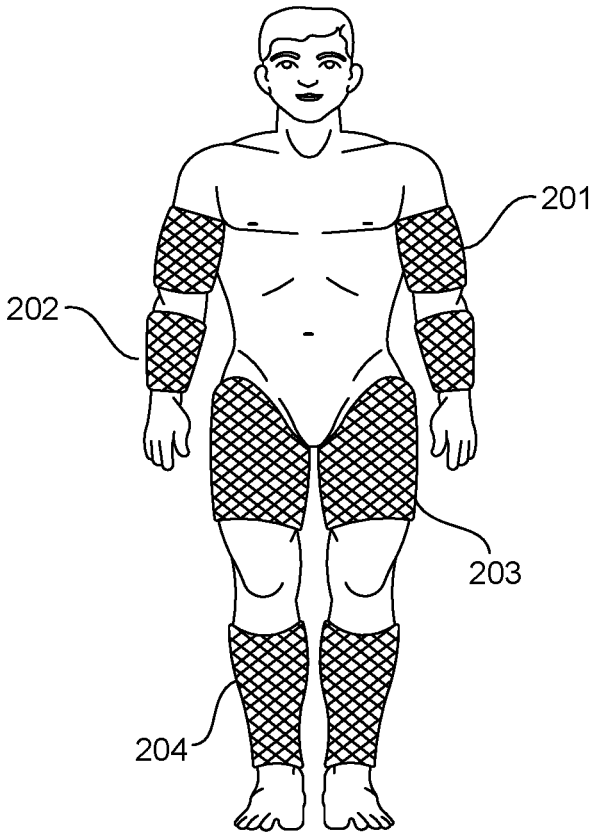
FIG. 2 illustrates the placement of plurality of inflatable bladders relative to the body of a wearer.
Figure 3:
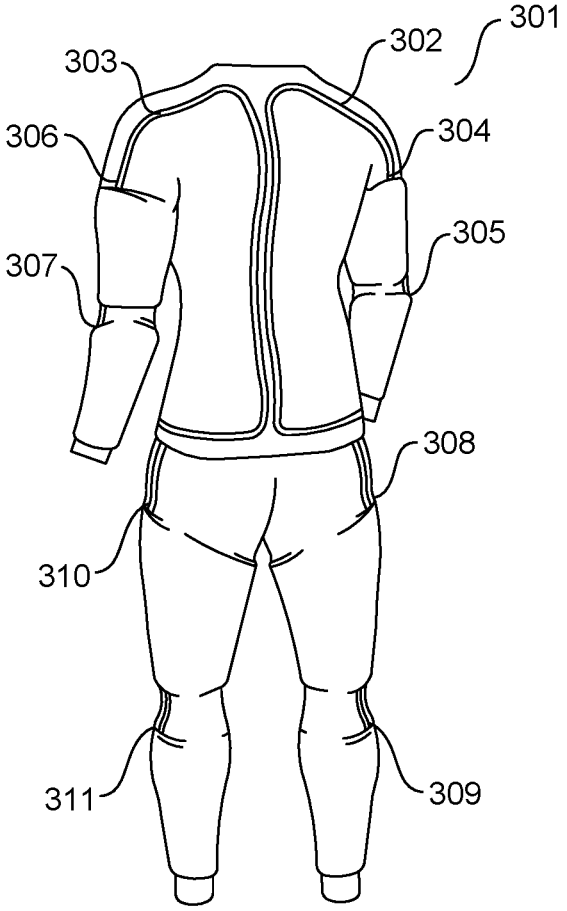
Figure 4:
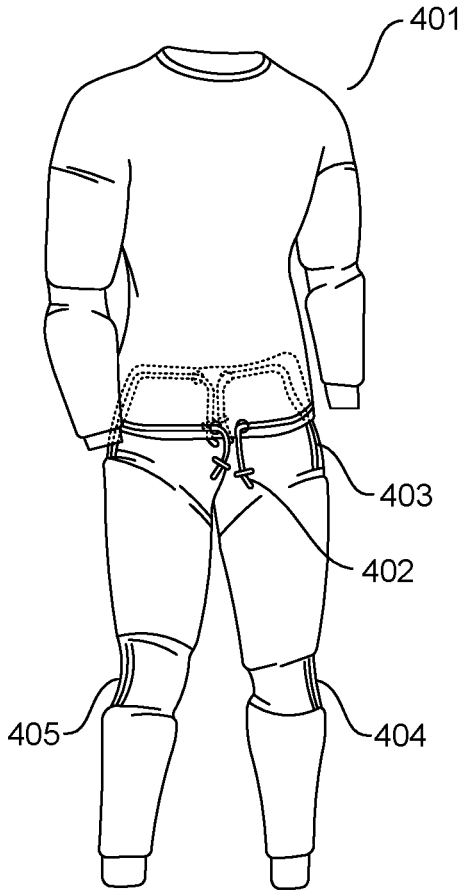
Figure 5:
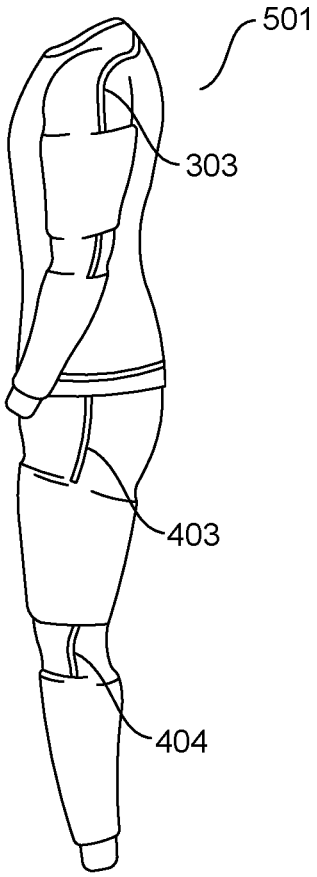
Figure 6:
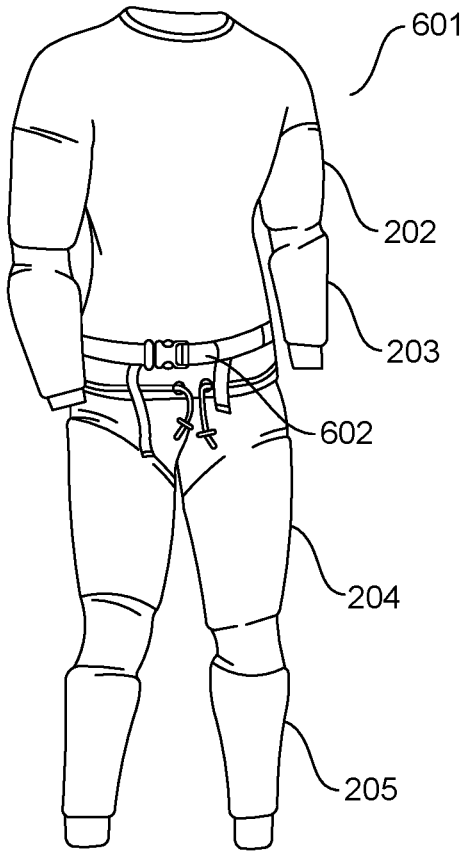
Figure 7:
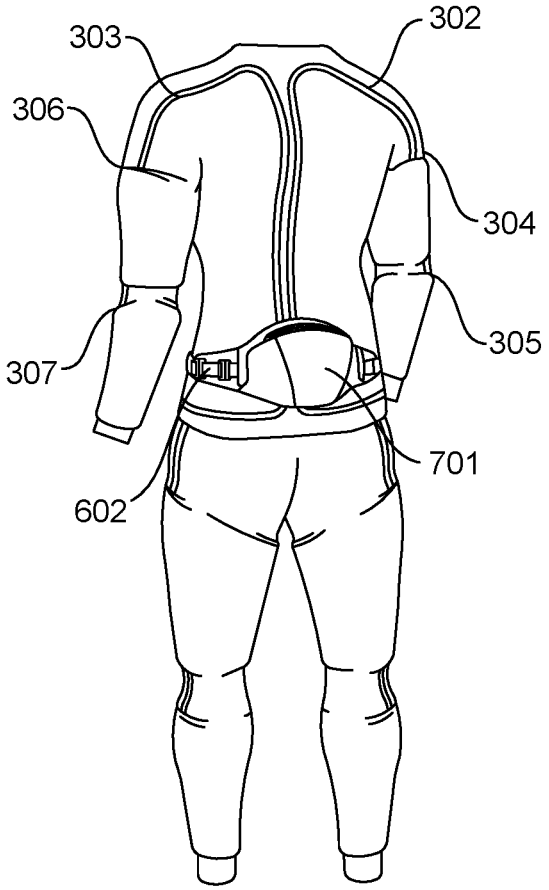
Figure 8:
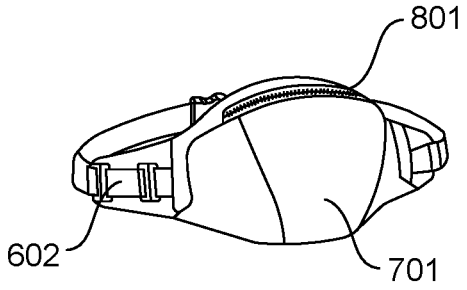
Figure 9:
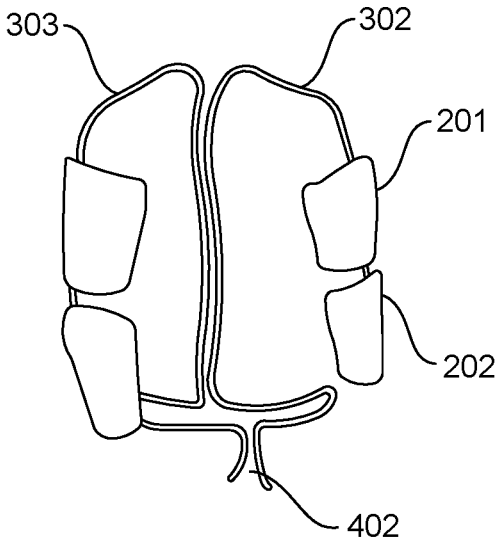
Figure 10:
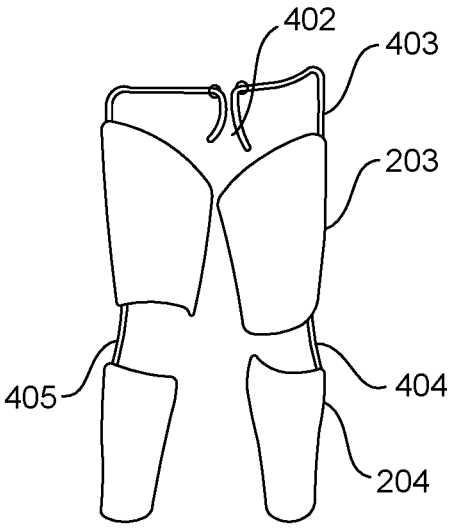
Figure 11:
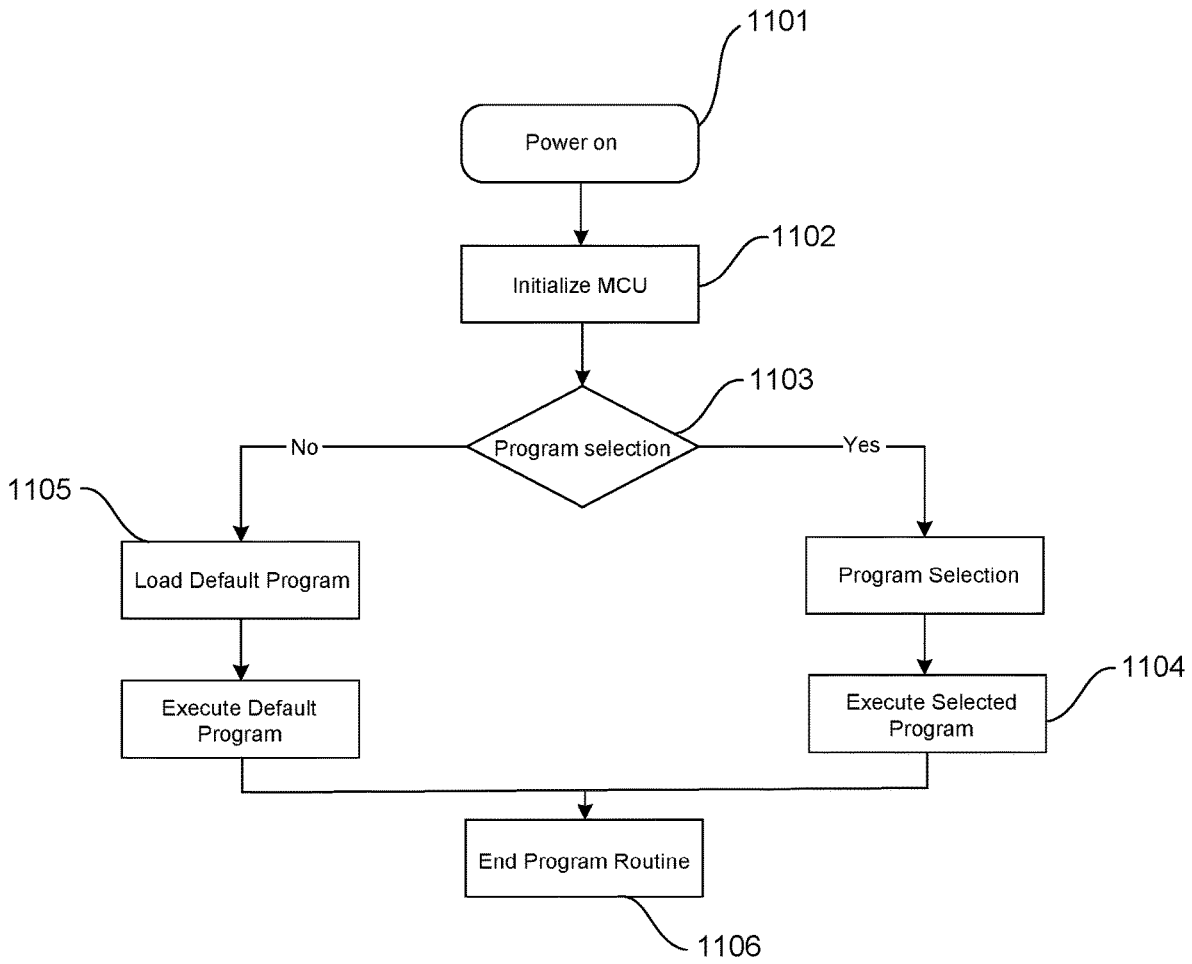
Figure 12:
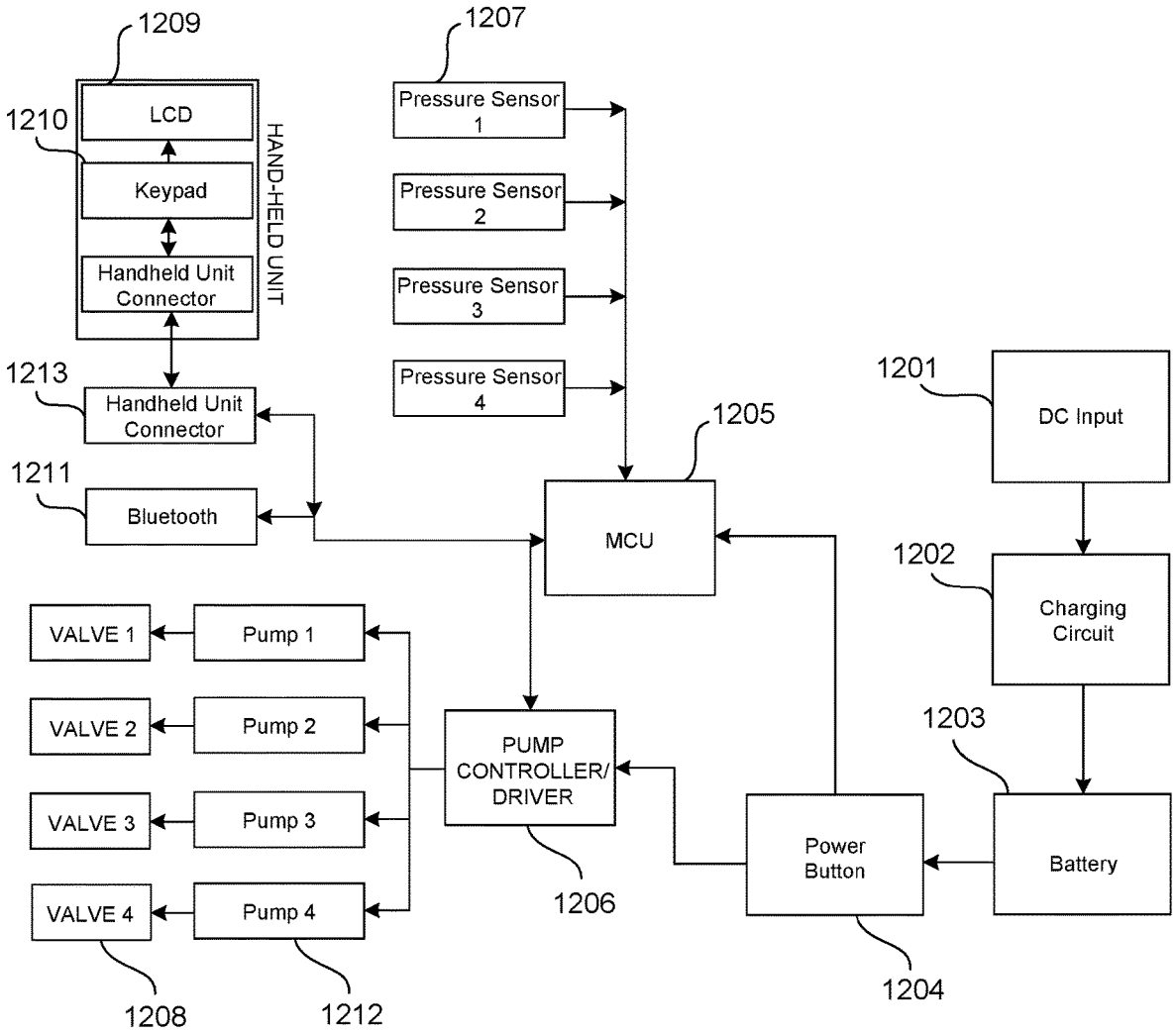
Figure 13:
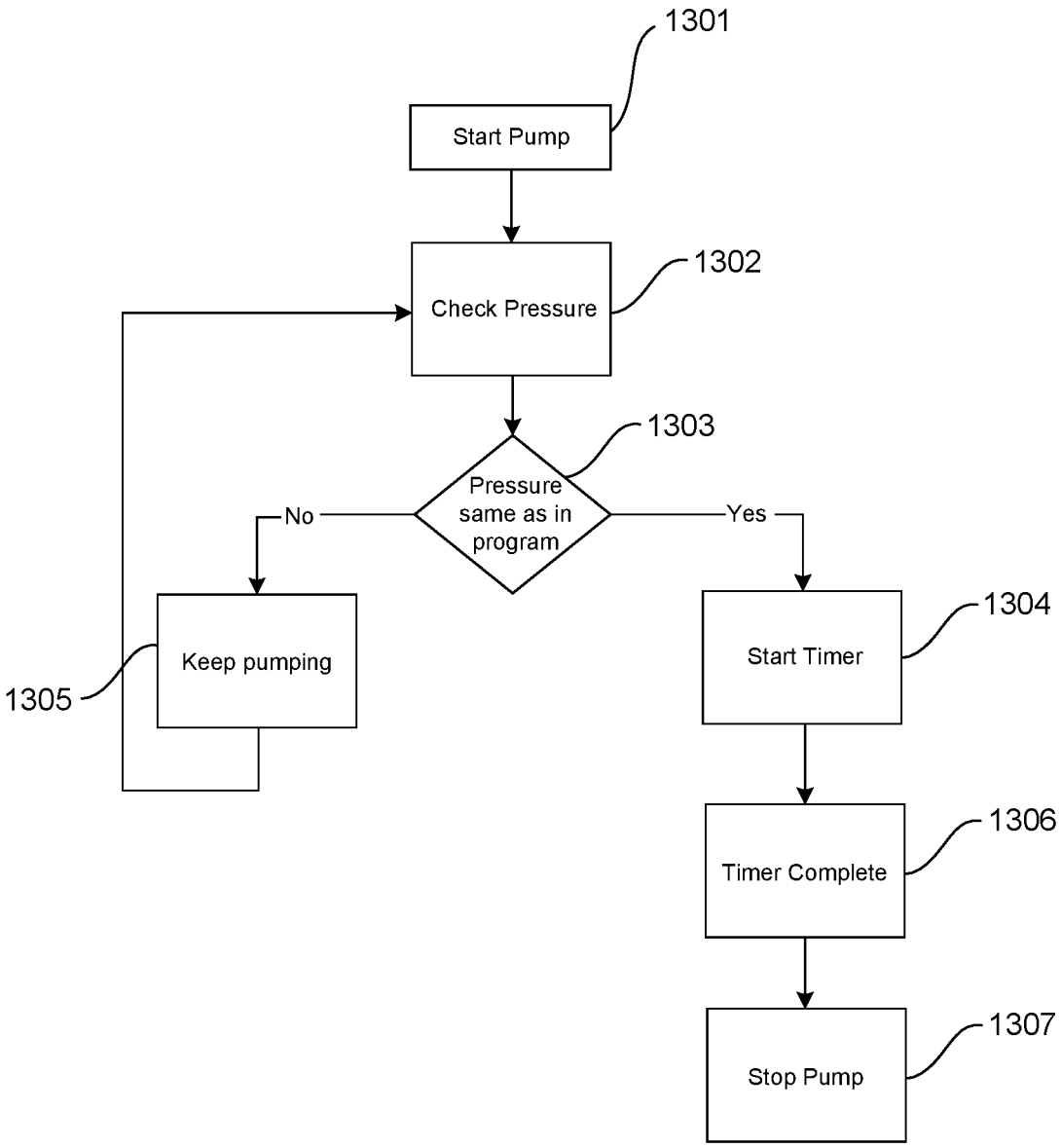

FIG. 3 provides a view of the network of embedded simply lines for supplying an inflation medium to the bladders. Particularly, it shows the view of embedded supply lines threaded into ports of bladders in the upper body portion;

FIG. 4 provides a view of embedded supply lines into ports of a performance training garment in a lower-body portion with ends protruding for coupling with an inflation medium reservoir;

FIG. 5 provides a further side view of embedded supply lines for supplying an inflation medium to the bladders of FIGS. 1 and 2;

FIG. 6 gives a front view of a performance training garment that includes a waist-height pouch mounted at the back for carrying containers of inflation medium and is secured with waist strap towards the front of the wearer;

FIG. 7 shows the view of a performance training garment dust includes a waist-height pouch for carrying containers of inflation medium;

FIG. 8 show the view of a waist-height pouch for carrying containers of inflation medium for use with the performance training garment of FIG. 1;

FIG. 9 illustrates the interrelationship between the components of the present invention in the upper body of the performance training garment;

FIG. 10 illustrates the interrelationship between the components of the present invention in the tower body of the performance training garment;

FIG. 11 shows a high-level flow diagram of a startup/shutdown sequence for a control program for a controller in a performance training garment;

FIG. 12 provides an architecture diagram of the function of control system in the performance training garment; and FIG. 13 provides a flow diagram of a process for inflating/deflating the bladders.

DETAILED DESCRIPTION OF THE INVENTION

In the following paragraphs, a brief and non-limiting description of the preferred embodiment is disclosed.

All through the specification, the technical terms and abbreviations are to be interpreted in the broadest sense of the respective terms, and include all similar items in the field known by other terms, as may be clear to persons skilled in art. Restriction or limitation if any referred to in the specification, is solely by way of example and understanding the present invention. Ranges may be expressed herein as from 'about' or 'approximately' another particular value. Also, it will be understood that unless otherwise indicated, dimensions and material characteristics stated herein are by way of example rather than limitation, and are for better understanding of sample embodiment of suitable utility, and variations outside of the stated values may also be within the scope of the invention depending upon the particular application.

Exemplary embodiments of the disclosure as described hereto generally include a wearable performance training garment that provides the effect of exercising to a high-G environment by furnishing external resistance against the wearer's muscles. Accordingly, while embodiments of the disclosure are susceptible to various modifications and alternative forms, specific embodiments thereof are shown by way of example to the drawings and will herein be described in detail. It should be understood, however, that there is no intent to limit embodiments of the disclosure to the particular exemplary embodiments disclosed, but on the contrary, embodiments of the disclosure cover all modifications, equivalents, and alternatives falling within the spirit and scope of the disclosure.

The present invention seeks to address the drawbacks associated with the existing compression gear wearable garments which only provide minor to moderate pressure benefits to its wearer and which mostly work due to placebo effect. To achieve this purpose, the present invention discloses a performance training garment that is designed to augment exercise workouts and can be worn on the lower, upper or entire body. It mimics the effects of working out in high G-environments. It achieves this by providing external resistance against which the muscles of the wearer must contract and thus subsequently strengthens them.

In one of the preferred embodiments of the present invention, the performance training garments provides for a compression garment that comprises a plurality of inflatable bladders embedded within said compression garment. Wherein the plurality of bladders are disposed only at extremities position of a wearer. The positions are selected to resist movement of the wearer's extremities when the plurality of bladders are partially inflated. The inflatable bladders may be placed within sleeves fabricated from carbon-fiber fabric that direct pressure toward the muscles of the wearer's extremities to increase the load tolerated during exercise. The garment further includes a reservoir for air source and at least one air supply line, a control system for the inflation that has a wearer operable interface. The reservoir may be carried in a pouch or pack worn at the user's waist. The body of the garment also includes a network of supply lines that is responsible for supplying air inflation medium to the bladders. Inflation and deflation system works through the network of embedded supply lines that conduct an inflation medium to the bladders from the reservoir. The network of supply lines further comprises a plurality of vales for regulating flow of the air medium in and out of the bladders. Further, certain portions of the garment may comprise a fabric bi-layer where the plurality of inflatable bladders are embedded between the layers of said fabric bi-layer. Also, the air supply lines are embedded between the layers of the bi-layer of the fabric.

For carrying out its working operation, the garment includes a control system having a wearer operable interlace that controls inflation and deflation of the bladders. During use, the wearer operates the controller to inflate, at least partially, any of all of the bladder(s) in order to simulate the effect of resistance trailing on the muscles and skeletal system of the wearer.

The performance training garment is useful in providing a full functional performance training. The inflatable bladders are disposed at positions only on the extremities in order to fully stress and develop the peripheral musculature. Performing physical training with some or all of the bladders inflated to one degree or another has the effect of making the training movements more difficult requiring greater muscle exertion on the part of the wearer, thus simulating an increased gravitational load that would be experienced if the wearer were training in a multiple-G environment.

In addition to increasing the gravitational load on the extremities, the full functional training enabled by the training garment of this invention, allows the wearer to subject his/her peripheral muscles to greatly increased pressure and impact levels, stressing the wearer's muscles in novel ways not previously possible with conventional resistance training equipment or compression apparel.

In other embodiments of this present invention, the resistance garment can assume the form of a long-sleeved top, an arm sleeve, a pair of leggings or tights, a knee-high stocking and a thigh-high stocking.

Referring particularly to FIG. 1, the performance trailing garment 101 of the present invention is shown to its preferred embodiment. The performance training garment 101 is preferably to the form of a shirt and a pair of tights. However, in other embodiments, the performance training garment may be a one-piece suit that covers substantially the wearer's entire body. In still other embodiments, the performance training garment may be an arm sleeve or a pair of arm sleeves. In further embodiments, the performance training garment may be a legging or a pair of leggings.

FIG. 2 illustrates the placement of plurality of inflatable bladders 201, 202, 203, 204 that are incorporated within the garment. The bladders are placed around the arms 201, 202, thighs 203 and lower leg 204. The inflatable bladders 201, 202, 203, 204 are inflated to exert a predetermined amount of compression on the large muscles of the wearer's extremities. By exerting compression against the muscles of the wearer's extremities, the performance training garment increases the amount of muscular force that must be applied by the wearer in order to perform normal and or athletic movements such as walking, running, lifting, throwing, jumping and the like. By increasing the muscular force required to perform ordinary athletic movements, the performance training garment is intended to simulate a G-load that is multiple times the normal accelerative force of the earth's gravity. By requiring the wearer to exercise under a higher-then-normal G-load, over time, a training effect is achieved that that has a highly beneficial effect, at least on the wearer's muscular strength. However, additionally, performing skilled movements under a high-than-number G-load also develops the wearer's eye-hand coordination, agility, reaction time and cardiovascular and respiratory fitness, so that notable improvements to overall fitness are achieved with continued use of the performance training garment.

In embodiments, the inflatable bladders 201, 202, 203, 204 may be fabricated from an inflatable fabric such as polyvinyl chloride (PVC) that has been bonded to a soft, water-proof fabric. The PVC and the fabric may be bonded using either of a heat or pressure bonding process. In another embodiment, the bladders may be fabricated from an inflatable fabric such as polyurethane laminate (PUL). In yet another embodiment, the inflatable bladders 201, 202, 203, 204 may be airtight. In other words, the bladders may be inflated and will stay inflated for an extended period of time, due to the choice of material and method of construction. For current embodiment, pieces of fabric may be joined to form the bladder using high-frequency welding or glue.

In other embodiments, the inflatable bladders 201, 202, 203, 204 may be non-airtight, meaning that the inflatable bladders will stay inflated as long as the air within the inflatable bladders is regularly replenished.

In further embodiments, the inflatable bladders may be placed within a sleeve. The provision of a sleeve to enclose the inflatable bladders, allows the outward compressive force of the inflatable bladders to be directed inward to the surface of the wearer's body, while minimizing external protrusion of the inflatable bladders due to externally-directed compressive force. Minimizing outward protrusion of the inflatable bladders achieves a number of advantages. First, by restraining outward protrusion of the inflatable bladders, a greater portion of the compressive force of the inflatable bladders is directed toward the body surface of the wearer, optimizing the ability of the inflatable bladders to exert compressive force on the wearer's muscles. Second, optimizing the ability of the inflatable bladders to deliver compressive force to the surface of the wearer's body minimizes the necessary thickness dimension for the inflatable bladders. Third, minimizing the thickness dimension of the compression reduces the material cost for the compression garment and generally improves manufacturability. Fourth, minimizing the thickness dimension of the inflatable bladders greatly improves the cosmetic appeal of the garment which serves to encourage more frequent use of the compression garment by the wearer. More frequent use of the compression garment, will, of course, greatly increase the probability that the wearer will derive a significant benefit from use of the garment.

In afore embodiment, the sleeve may be fashioned from a fabric woven from carbon fiber filaments. The carbon fiber fabric may comprise a non-rigid carbon fiber such as CX6 (CARBITEX, INC., KENNEWICK, Wash.). Likewise, other carbon-fiber composites may be used that provides the required properties of non-rigidity and high strength.

FIG. 3 illustrates the network of the embedded supply lines 301 for supplying the inflation medium to the bladders 201, 202, 203, 204 as shown in FIG. 2. The supply lines as described herein are generally referred to air hoses 302, 303, 403, 404, 405 that are embedded throughout the lining of the garment. The air supply hoses 302, 303, 403, 404, 405 provide inflation median to the bladders from a reservoir (as shown in FIG. 8) of inflation medium. The inflation medium is canned, compressed air that is housed to the waist pouch 701, (shown to FIG. 8). In FIG. 3, the supply lines 302, 303, 403, 404, 405 are threaded into ports to the garment and are conducted along channels provided to the fabric body of the garment to an inlet valve 304, 305, 306, 307, 308, 309, 310, 311 on each bladder. The bladders may be connected to series by a single supply line. In another embodiments, bladders may be connected to parallel by multiple supply lines. FIG. 4 illustrates the view of embedded supply lines 403, 404, 405 into ports of the performance training garment in a lower body portion 401 with its ends 402 protruding for coupling with an inflation medium reservoir.

FIG. 5 provides a further side view 501 of embedded simply lines 303, 403, 404 for supplying an inflation medium to the bladders 201, 202, 203, 204. Outlet valves on the bladders allow deflation of the bladder under control of the wearer. Values couple one or more containers of compressed air to the network of supply lines.

FIG. 6 gives a front view 601 of a performance training garment that includes a waist-height pouch 701 placed at the back for carrying containers of inflation medium and the control system. The waist height pouch is fastened towards the front of the wearer 602.

FIG. 7 shows the view of a performance training garment that includes a waist-height pouch 701 for carrying containers of inflation medium. The waist height pouch rests at the back of the wearer.

FIG. 8 shows the view of a waist-height pouch 701 for carrying containers of inflation medium for use with the performance training garment of FIG. 1. The waist-height pouch holds the containers of inflation median and houses the inflation control system of FIG. 12 operated by wearer handheld device. The containers of compressed air may be cans of compressed air such as those available in office-supply stores for cleaning dust from computer equipment. Alternatively, the inflation medium may be compressed nitrogen. The inflation median may be supplied by a miniature compressor carried in the pouch. In this embodiment, the waist-height pouch 701 is generally in form of a bag or pack that has a zipper 801 and is worn around the waist of the wearer and is further secured to a waist strap 602. The waist-height pouch is reposed at the back of the wearer.

FIG. 9 and FIG. 10 illustrates the interrelationship between the components of the present invention. Essentially, it shows the interrelationship of the plurality of supply lines 302, 303, 402, 403, 404, 405 and inflatable bladders in the upper 201, 202 and lower body 203, 204 of the performance training garment. The plurality of valves 304, 305, 306, 307 within the supply lines regulate the flow of air in and out of the respective bladders.

As shown in FIGS. 11-13, the performance training garment includes an inflation control system having a wearer-operable interface. Wearer-operable control valves regulate the flow of medium to the bladders, so that the degree of inflation and the speed at which the bladders inflate under the control of the wearer. Particularly, FIG. 11 shows the electronic flow chart of how the wearer hand held device or app would control the performance training garment. Disclosed invention is configured to control the inflation and deflation of the bladders through any wearer handheld devices such as smart phones and routed to the mobile application for display to a wearer. The handheld device gets connected to the inflation control system of the performance training garment through the mobile application window. At first instance, the control device is powered on to get it started 1101. Then, the system would initialize the inputs from the Microcontroller unit 1102 and verify the program selection 1103. If the selected program is verified, it will next execute the selected program 1104 of inflation or deflation and end the program routine. Otherwise, the system will load the default program 1105 and then execute it 1104.

FIG. 12 shows the process flow of the coordination between the independent components of the present invention to carry out the objective of the invention. The independent components such as the wearer operated hand held device 1209, 1210, Microcontroller unit 1205, Bluetooth 1211, battery 1203, charging circuit 1202, pump controller 1206, etc., Air pups 1212 and Valves 1208, Pressure Sensors 1207. All of these components are housed in the waist height pouch 701. The inflation control system can be put to work through battery that charged by DC Input 1201. The control system has a power button 1204 to activate or deactivate the control device without fully disconnecting it from the power supply. The control system further includes a Microcontroller unit 1205 and Pump controller 1206 and pressure sensors 1207. The microprocessor unit 1205 consists of processors and programmable input and output to control the degree of inflation and deflation relative to the wearer input instructions given at the handheld device. The pressure sensors 1207 herein detect and indicate when the air pressure has reached a specified level weight. The pump controller 1206 regulates the pressure on the inflatable bladder. The control system further provides logic for either, actuating single valves or actuating all valves at once or actuating pre-determines subsets of valves or actuating wearer-configured subsets of valves 1208.

The handheld device may be connected to the Microcontroller of the control system through Bluetooth 1211 or other connector 1213. The handheld device is the wearer operable interface that operates and controls the required inflation and deflation of the bladders 201, 202, 203, 204. The handheld device could be a smartphone, tablet or any similar Bluetooth enabled display devices. The handheld device includes LCD 1209 to display of the functions and keypad 1210 to input the functional operators in the desired manner.

FIG. 13 is a block diagram that shows the logic of the firmware, i.e. how the process of inflation and deflation of bladders functions. Pursuance to the input given on the handheld device, the control device stalls pumping 1301 the bladders 201, 202, 203, 204, next to it, the pressure sensors 1207 checks the pressure generated through pumping 1302. If the pressure is found to be same as the input program 1303, it begins pumping to inflate the bladders according to the timer 1304 and after it reaches the set time range 1306, the control device commands to stop punning 1307. In contrary, if the pressure is found minimal with the program, the program commands for further pumping until the pressure is observed to be at par with the input program 1305.

In this embodiments, the garment is fabricated from a fabric that is highly elastic to fit the wearer's body closely and tightly. The garment is fabricated from a knitted fabric, wherein the knitted fabric may be comprised of polyurethane, polyester-polyurethane copolymer or cotton. In an embodiment, that fabric may be a polymer such as spandex. Additionally, spandex washes easily and withstands repeated washing well without losing its elasticity.

In embodiments, the bladders are situated to cover the larger muscle body parts of the extremities, such as the upper arms and the thighs.

I claim:

1. A performance training garment comprising:

a compression garment;

a plurality of inflatable bladders embedded within said compression garment;

a network of supply line coupled to each of the plurality of inflatable bladder and to an air source; and an inflation and deflation control system having a wearer operable interface;

wherein the air source and the inflation and deflation control system are housed in a waist-height pouch configured to be mounted at a back of a wearer.

2. The performance training garment of claim 1, where the inflation and deflation control system comprises of;

a processor;

a display; and computer readable instruction for controlling inflation of the said plurality of inflatable bladders and providing said wearer-operable interface on said display.

3. The performance training garment of claim 2, wherein the inflation and deflation control system comprises of;

a plurality of electronically-actuated inflation control valves; and at least one control circuit for actuating said plurality of electronically-actuated inflation control valves.

4. The performance training garment of claim 3, wherein said control circuit includes logic for:

actuating one of said plurality of electronically-actuated inflation control valves;

actuating all of said plurality of electronically-actuated inflation control valves at once;

actuating pre-determines subsets of said plurality of electronically-actuated inflation control valves;

actuating wearer-configured subsets of said plurality of electronically-actuated inflation control valves; and controlling degree of inflation of each bladder of the plurality of inflatable bladders.

5. The performance training garment of claim 2, where the wearer operates the inflation and deflation of the plurality of inflatable bladders on a handheld unit.

6. The performance training garment of claim 1, where the network of supply lines are conducted along channels provided in the compression garment to an inlet and outlet valve on each bladder of the plurality of inflatable bladders.

7. The performance training garment of claim 6, where the inlet and outlet valves are coupled to one or more container of compressed air allowing air passage to the network of supply lines.

8. The performance training garment of claim 6, where the inlet valve allows compressed air from the container of compressed air to enter a respective bladder of the plurality of inflatable bladders for inflation.

9. The performance training garment of claim 6, where the outlet valve allows compressed air from the container of compressed air to exit a respective bladder of the plurality of inflatable bladders for deflation.

10. The performance training garment of claim 1, wherein at least portions of said compression garment comprise a fabric bi-layer.

11. The performance training garment of claim 10, wherein said plurality of inflatable bladders are embedded between layers of said fabric bi-layer.

12. The performance training garment of claim 10, where at least one supply line of the network of supply lines is embedded between said bi-layers.

13. The performance training garment of claim 1, wherein said compression garment is fabricated from a knitted fabric.

14. The performance training garment of claim 13, wherein said knitted fabric is composed of at least one of Polyurethane, Polyester-polyurethane copolymer and Cotton.

15. The performance training garment of claim 1, wherein the said compression garment is configured to include at least one of a shirt, a pair of tights or a full body suit.

16. The performance training garment of claim 1, wherein the plurality of inflatable bladders are disposed only at extremities positions of the wearer.

17. The performance training garment of claim 1, wherein during use the plurality of inflatable bladders are at least partially inflated.

18. The performance training garment of claim 1, where said air source is removably mounted on the said waist-height pouch.

19. The performance training garment of claim 1, wherein said air source comprises one of:

a battery-powered compressor;

at least one container of compressed air; or at least one container of nitric oxide air.

* * * * *